US008141286B1

(12) United States Patent
Saur

(10) Patent No.: US 8,141,286 B1
(45) Date of Patent: Mar. 27, 2012

(54) CHEEK REST FOR FIREARM

(75) Inventor: Thomas W. Saur, Dearborn, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 158 days.

(21) Appl. No.: 12/464,346

(22) Filed: May 12, 2009

(51) Int. Cl.
*F41C 23/08* (2006.01)
*F41C 27/00* (2006.01)

(52) U.S. Cl. ..... 42/74; 42/96

(58) Field of Classification Search ..... 42/74, 96
See application file for complete search history.

(56) References Cited

U.S. PATENT DOCUMENTS 2,932,334 A * 4/1960 Steen ..... 206/317
4,105,220 A * 8/1978 Pacific ..... 280/304.4
4,644,930 A * 2/1987 Mainhardt ..... 124/58
5,871,269 A * 2/1999 Chien ..... 362/474
6,986,221 B2 * 1/2006 Mullis ..... 42/74
7,040,642 B2 * 5/2006 Lowry ..... 280/304.1
7,162,822 B1 * 1/2007 Heayn et al. ..... 42/73
2007/0062090 A1 * 3/2007 Brindle ..... 42/96

* cited by examiner

*Primary Examiner* — Michael Carone
*Assistant Examiner* — Joshua Freeman
(74) *Attorney, Agent, or Firm* — Michael C. Sachs

(57) ABSTRACT

There is shown in this invention a face cheek rest for a firearm that cushions a shooter (to generally aim then shoot) against uncomfortable interaction with harsh surfaces on a firearm buttstock or body. The cheek rest provides a secure, easy to clamp on and use interface, which is very comfortable and cushioning. The device is made to be light weight as well as low cost and aesthetically pleasing. This cheek rest can be used equally well on a weapon employing a folding metal butt stock assembly, other type collapsible firearm butt stock, or most any other standard type firearm.

9 Claims, 8 Drawing Sheets

B1

B2

B3

B4

B5

CHEEK REST FOR FIREARM

STATEMENT OF GOVERNMENT INTEREST

The inventions described herein may be made or used by or for the U.S. Government for U.S. Government purposes.

BACKGROUND OF INVENTION

Various conventional improvised face cheek rests for a firearm butt stock have been used. Such include a stack of folded flat material taped to the rifle butt stock, a cheek rest formed by wrapping the firearm butt stock with padding tape, using a firearm sling as a cheek rest, using a portion of a parka worn by the firearm user as a cheek rest, and using the left hand as a cheek rest by the firearm user while the firearm is operated with the right hand. Such expediencies have one or more deficiencies including improvised nature, not being secure, time consuming to install and remove, expensive, relatively heavy, not comfortable, unattractive, and generally not suitable for use on a collapsible or folding butt stock.

In contrast, the cheek rest of the present invention provides a secure, easy to use, adaptable, low cost, comfortable, light weight, cushioning, and aesthetically pleasing interface between a harsh firearm surface (e.g., a folding metal butt stock assembly, a collapsible firearm butt stock, for instance) and the face cheek of the firearm user.

While many conventional cheek rests are limited to specific applications, the cheek rest of the present invention may be advantageously implemented in connection with the Ingram/MAC 10 and 11, Heckler and Koch MPS, MP40, U.S. M3/M3AI submachine gun, MAT 49, Sterling L2A3, PPS43, AK47 under-folder, and similar firearms having metal bar/wire stocks with one or two parallel, generally horizontal bars, as well as with the full-size Uzi folding metal stock shown in FIGS. 6-7. Further, the cheek rest of the present invention may be implemented in connection with telescopically collapsible stocks such as the types described in U.S. Pat. Nos. 3,348,328 and 7,162,822. Yet further, the cheek rest of the present invention may be implemented in connection with conventional fixed butt stocks.

OBJECTS OF THE INVENTION

It is an object of the present invention to provide a face cheek rest for a firearm that is secure, easy to use, adaptable and relatively low cost.

It is a further object of the present invention to provide a face cheek rest for a firearm that is also comfortable, light weight, cushioning, and aesthetically pleasing.

It is a still further object of the present invention to provide a cheek rest that may be implemented in connection with telescopically collapsible stocks such as an Uzi weapon, as well as with other conventional buttstock type weapons.

These and other objects, features and advantages of the invention will become more apparent in light of the following detailed description of the invention.

BRIEF SUMMARY OF INVENTION AND DESCRIPTION OF DRAWINGS

According to an embodiment of the present invention shown, these and other objects are accomplished by a face cheek rest device having sketches, in which.

Figure 1:
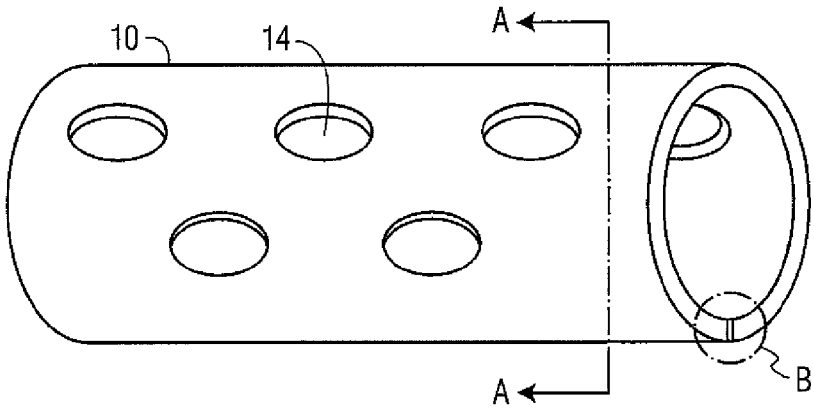
FIG. 1 shows a perspective (isometric) view of the cheek rest.
Figure 5A:
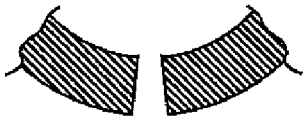
Figure 5B:
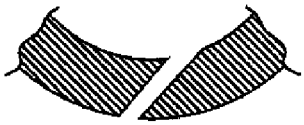
Figure 5C:
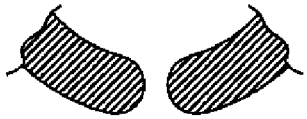
Figure 5D:
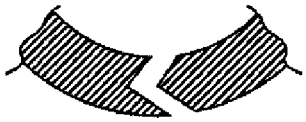
Figure 5E:
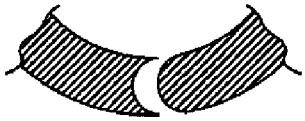

FIGS. 5A-5 E show examples of possible shapes of lips for the slit cut areas, one end of which slit cut areas is pointed to as "B" in FIG. 1.

Figure 6:
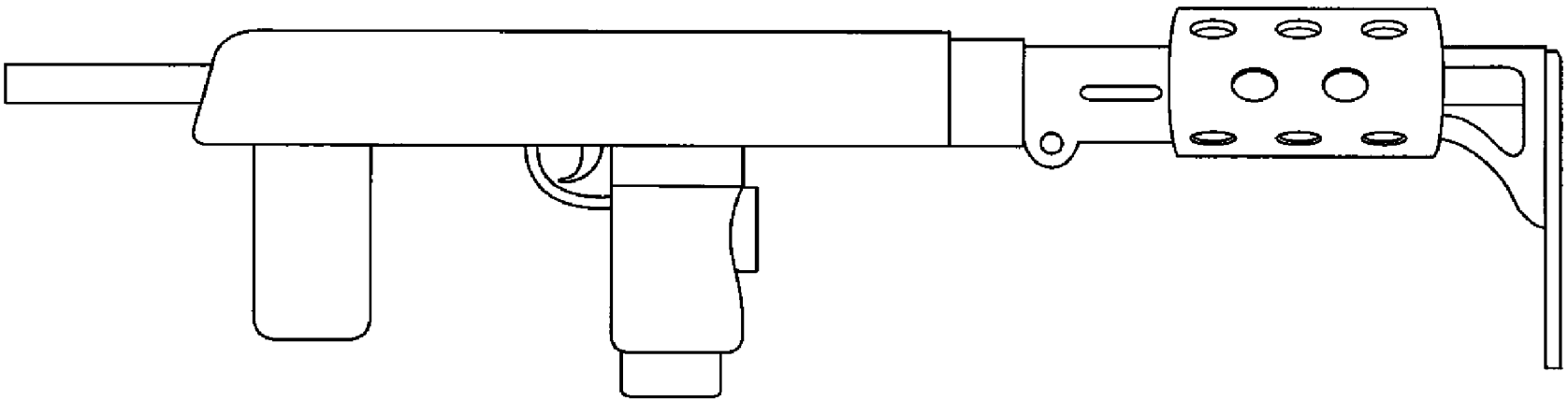

FIG. 6 illustrates a side view of an embodiment of the present invention having oblong lightening holes; wherein the cheek rest is shown installed on a firearm.

Figure 7:
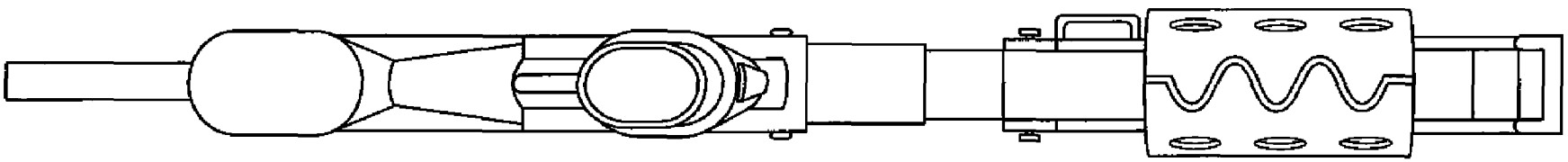

FIG. 7 illustrates a left side elevation view of the firearm having butt stock cheek rest of FIG. 1, with scalloped shaped mating surface slits, and installed on a firearm having a collapsible metal butt stock.

FIGS. 8A-8H show examples of other possible patterns of the slit cuts, one end of which cuts is identified in area "B" of FIG. 1.

Figure 9A:
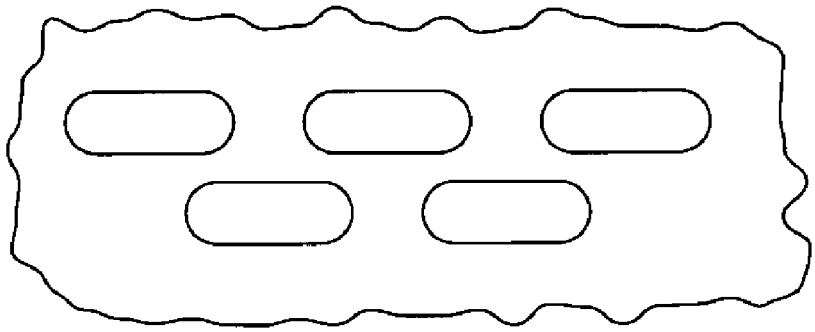
Figure 9B:
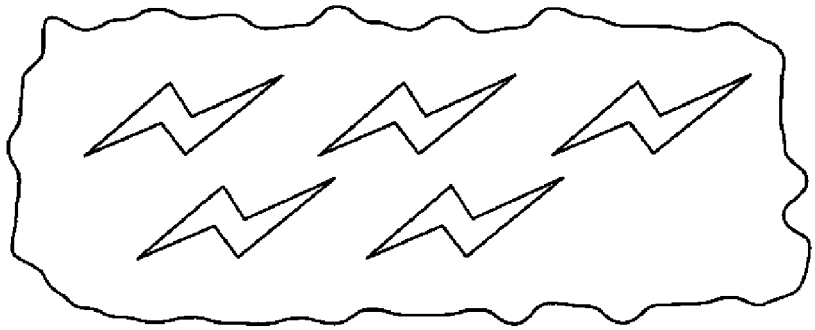
Figure 9C:
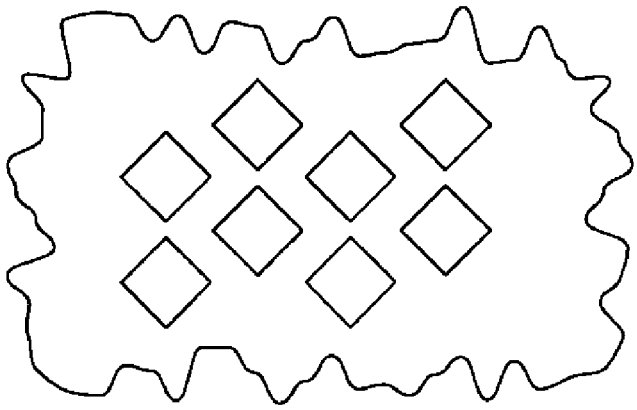
Figure 9D:
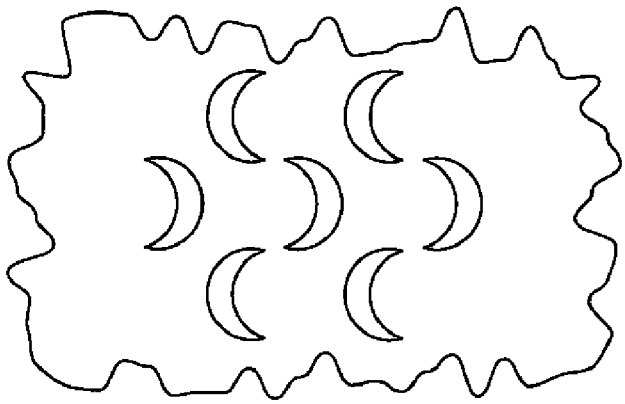
Figure 9E:
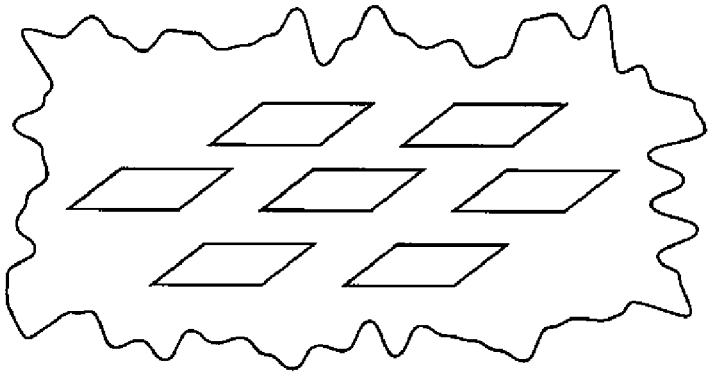
Figure 9F:
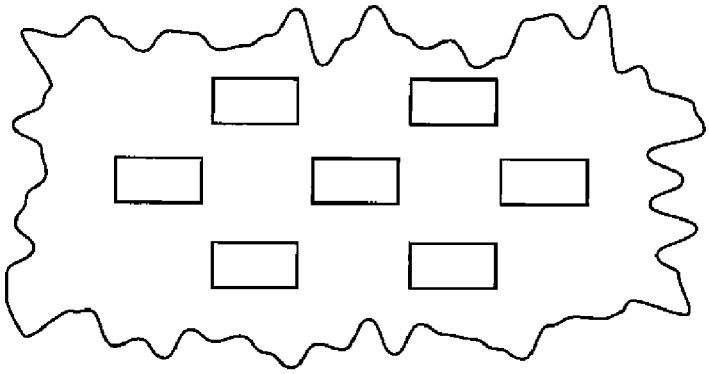

FIGS. 9A-9F show examples of other possible shapes of the holes shown as 14 in FIG. 1. FIG. 9A shows oblong slot shapes, FIG. 9B shows lightning bolt shapes, FIG. 9C shows diamond shapes, FIG. 9D shows quarter moon shapes (eyebrows, scallops), FIG. 9E shows trapezoid shapes, and FIG. 9F shows rectangle shapes.

DETAILED DESCRIPTION

Figure 2:
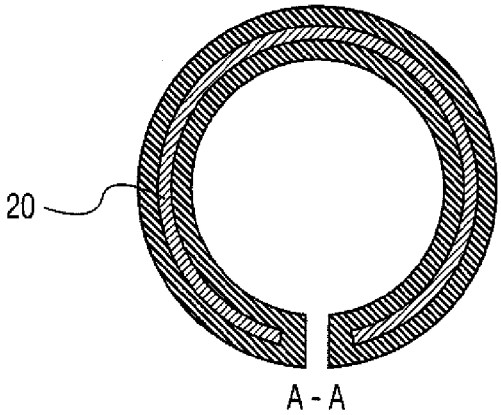
FIG. 2 shows addition of a spring means to the cheek rest of FIG. 1.
Figure 3:
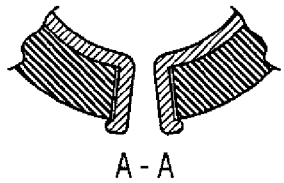
FIG. 3 shows lips on spring means 20 of FIG. 1, to aid in installation of such spring means 20.
Figure 4:
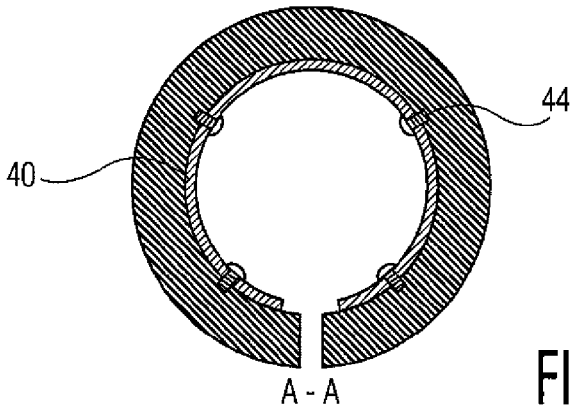
FIG. 4 shows addition of an alternate spring means to the cheek rest of FIG. 1.
Figure 8A:
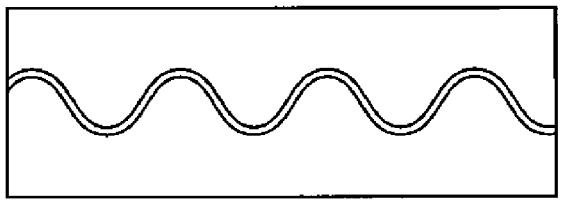
Figure 8B:
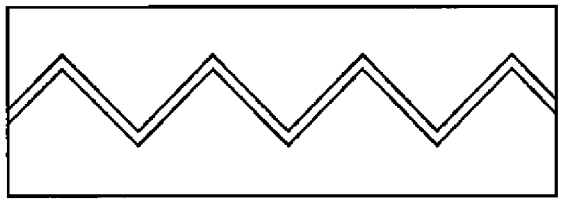
Figure 8C:
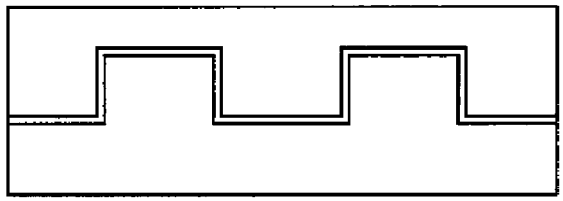
Figure 8D:
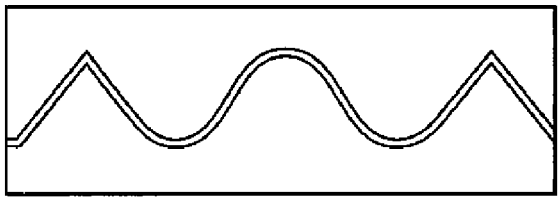
Figure 8E:
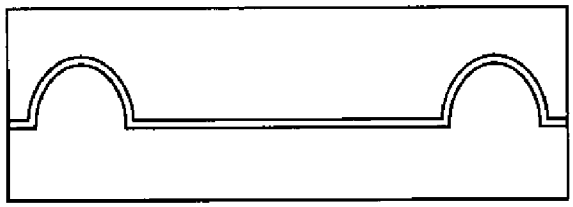
Figure 8F:
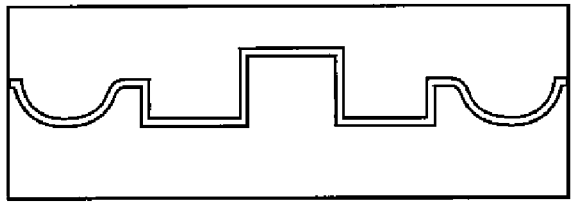
Figure 8G:
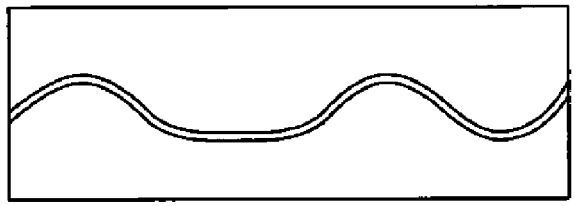
Figure 8H:
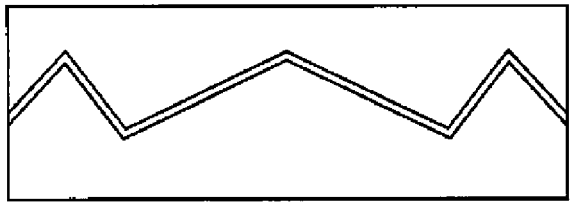

The cheek rest is shown in perspective (isometric) view in FIG. 1. The cheek rest is a shell 10, being a hollow cylinder of flexible material. Shell 10 will typically be about ⅛" to ½" thick and 4" to 6" in length. Cheek rest shell 10 has a longitudinal slit cut in it to aid in fully opening the cheek rest for installation around a selected component or longitudinal part, of a subject firearm. One end of the slit cut areas can be seen in cross sectional views FIGS. 2 and 4 along section lines A-A, and is also generally pointed to in "B" of perspective view FIG. 1. The cheek rest has holes generally shown as 14 through the shell 10. The holes 14 could cover 20% to 80% of the total surface area of the cheek rest, but about 30% to 60% is generally used. The purpose of the holes as was mentioned is to lighten the weight of the cheek rest, for even with the holes therein, the surface of the cheek rest provides a comfortable place for a shooter to rest his face cheek thereupon as a kind of padding. Any weight reduction is useful and welcome to the shooter for the firearm must be physically carried, probably together with other equipment. In FIG. 2, a spring means 20 may also be added to shell 10 by being embedded therein such as by being molded in or being encapsulated therein. If spring means are used there would generally be one near each longitudinal end of the shell. When additional clamping force is desired springs can be added along the length of the shell 10. Springs may be steel or plastic, e.g., and width might vary from about ¼" to 1" though typically about ½" wide, and less than 1/16" thick. If the embodiment of FIG. 4 is used, rather than being embedded, a spring means 40 may be concentrically attached to the inside of the shell means by plastic push pins 44, and such spring means 40 might also have lip means for attachment such as are shown in FIG. 3. FIGS. 5A-5 E show examples of possible shapes of lips which could be chosen for the slit cuts. FIGS. 9A-9F show examples of other possible shapes of holes which could be substituted for the holes now shown as 14 in FIG. 1, and; FIGS. 8A-8H show examples of other possible patterns of the slit cuts which might be chosen, one end of which slit cuts is shown as "B" of FIG. 1. For example, FIG. 8A shows a sinusoidal (scalloped) pattern, FIG. 8B shows a saw tooth pattern, and FIG. 8C shows a square wave pattern.

In particular, the cheek rest of the present invention (as illustrated in FIGS. 1, 2, 6-7) is implemented as a substantially cylindrical (i.e., tube, pipe, hose, and the like) shaped apparatus made from a rigid yet resilient material (e.g., rubber or plastic that is molded or extruded) having a scalloped (e.g., wave-shaped) pattern edge slit which provides a fast, convenient, simple and yet secure mounting via the mating slit edge surface. This fully functional initial example illustrated in FIGS. 6-7 is shown in connection with use in the operation of a full size Uzi firearm having folding buttstock. In another embodiment (e.g., FIG. 8B), the cheek rest of the present invention may be implemented having a saw-tooth (e.g., substantially triangular) edged slit in lieu of the scalloped slit illustrated in FIG. 7. In yet another embodiment (e.g., FIG. 8D), the edge of the slit may be a combination of mating scalloped and triangular shaped cuts. The cheek rest is implemented having a plurality of lightening holes such that the weight of the cheek rest is reduced while a user friendly "cheek weld" surface remains presented to the user and "bite" from the harsh surface of the butt stock when firing is reduced or eliminated. While the lightening holes illustrated in FIG. 1 are substantially circular in shape, other shapes, for example, triangular, oval, oblong, "lightning bolt", and the like, may be implemented (as shown, for example, in FIGS. 9A-9F). While the lightening holes provide weight reduction, the lightening holes are also generally configured to provide an aesthetically pleasing appearance.

To install the cheek rest, the user spreads the cheek rest open at the slit and positions the cheek rest on the respective firearm butt stock and releases the cheek rest. As the cheek rest is made from a flexible and resilient material, the cheek rest automatically recloses at the slit to secure the mounting to the butt stock. As well as an aesthetically pleasing appearance, the cheek rest also provides a surprisingly comfortable surface to the face cheek of the user.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A cheek rest for attachment to a firearm to interlace between a harsh firearm surface essentially fore of the buttstock of said firearm but rear of the optical sight of said firearm and the face cheek of the firearm user to cushion the face of a shooter, comprising only a hollow cylindrical shell of flexible and resilient material, said shell having a longitudinal slit forming lips therein to open the cheek rest for installation around a selected component or longitudinal part of the firearm, said flexible and resilient material providing means thereby for the cheek rest to completely grasp said firearm, wherein the cheek rest has holes therein generally covering about 30% to 60% of the surface area of the cheek rest.

2. A method of preparing to shoot a firearm which has a harsh surface positioned rear of the optical system of the firearm but fore of the buttstock of the firearm comprising the steps of: protecting the face of a firearm shooter during firing where the shooter's face is expected to be positioned on said harsh surface by the steps of preparing a hollow cheek rest device having longitudinal slits thereon by prying it open so that it may inserted onto said harsh surface; preliminarily inserting said cheek rest device so that is emplaced around said harsh surface; ceasing the step of prying open of said cheek rest device, so that the cheek rest device may be applied, then released to close around said harsh surface and thereby completely grasp the harsh surface; and resting one's face cheek upon said cheek rest device before commencing to shoot said firearm, wherein the cheek rest device has a means for grasping embedded therein to further aid in applying the cheek rest to the firearm.

3. The method of claim 2 wherein the cheek rest device has holes therein generally covering about 30% to 60% of the surface area of the cheek rest.

4. The method of claim 2 wherein the harsh surface is on a firearm from the group which includes the features of: a folding metal butt stock assembly, and a folding metal stock having metal bar/wire component stocks with one or two parallel generally horizontal bars.

5. The method of claim 2 wherein the means for grasping includes steel.

6. The method of claim 2 wherein the means for grasping includes multiple springs.

7. The method of claim 2 wherein the means for grasping includes plastic.

8. The method of claim 2 wherein the cheek rest device includes a rubber surface.

9. The method of claim 2 wherein the cheek rest device includes a plastic surface.

* * * * *